US009525216B2

(12) United States Patent
Wu et al.

(10) Patent No.: US 9,525,216 B2
(45) Date of Patent: Dec. 20, 2016

(54) SHIFT MEMBER FIXING STRUCTURE OF ELECTRICAL CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/954,014

(22) Filed: Nov. 30, 2015

(65) Prior Publication Data

US 2016/0204526 A1 Jul. 14, 2016

(30) Foreign Application Priority Data

Jan. 13, 2015 (TW) ..... 104200498 U

(51) Int. Cl.
*H01R 4/24* (2006.01)
*H01R 4/48* (2006.01)
*H01R 13/629* (2006.01)

(52) U.S. Cl.
CPC ..... *H01R 4/4809* (2013.01); *H01R 4/4836* (2013.01); *H01R 13/62955* (2013.01)

(58) Field of Classification Search
CPC ..... H01R 4/4818
USPC ..... 439/441, 838, 729
See application file for complete search history.

(56) References Cited

U.S. PATENT DOCUMENTS 5,685,735 A * 11/1997 Hohorst ..... H01R 4/4836 439/441
7,859,920 B2 * 12/2010 Jung ..... G11C 7/08 365/189.15
8,388,387 B2 * 3/2013 Koellmann ..... H01R 4/4845 439/729

* cited by examiner

*Primary Examiner* — Phuong Dinh
(74) *Attorney, Agent, or Firm* — Rosenberg, Klein & Lee

(57) ABSTRACT

A shift member fixing structure of electrical connection terminal includes an assembly of a terminal and a shift member to improve the shortcoming of the conventional terminal that the structure is complicated and the manufacturing cost is higher. The terminal includes a main body defining a chamber and a metal leaf spring disposed in the chamber for pressing a conductive wire or releasing the conductive wire in response to the operation of the shift member. A predetermined section of the shift member is formed with an insertion section and walls defining the insertion section. A part of the wall is removed to provide elastic effect for the insertion section. The removed part is repositioned on a surface of upper section of the main body to form an interference section. After the shift member is pressed down, the interference section is assembled with the insertion section.

19 Claims, 5 Drawing Sheets

SHIFT MEMBER FIXING STRUCTURE OF ELECTRICAL CONNECTION TERMINAL

BACKGROUND OF THE INVENTION

1. Field of the Invention

The present invention relates generally to a shift member fixing structure of electrical connection terminal, and more particularly to a terminal device for an electrical conductive wire to insert and connect with. The shift member is formed with an insertion section and walls defining the insertion section. Apart of the wall is removed to provide elastic effect for the insertion section. The removed part is repositioned on a surface of the main body to form an interference section. The insertion section and the interference section together set up a fixing system. Only when an operational force is applied to the shift member to release the shift member from the assembling or interference state, the shift member can be further moved. The shift member fixing structure of electrical connection terminal can be easily and conveniently operated.

2. Description of the Related Art

A conventional connection terminal (block) or wire-pressing terminal (block) has an insulation case (generally made of plastic material). A metal member or metal leaf spring is enclosed in the insulation case to press a conductive wire inserted in the connection terminal and electrically connect with the conductive wire. For example, EP 2325947 A1 and U.S. Pat. No. 6,341,989 B1 disclose typical electrical connection terminals.

The conventional connection terminal is for inserting on a circuit board (such as a PCB). The conventional connection terminal includes an insulation case and a shift member reciprocally movably mounted on the case. The case has a through hole or wire inlet for a conductive wire to insert into the case. The case defines a chamber in which a metal leaf spring is mounted. The shift member is operable to control the metal leaf spring into contact or electrical connection with the conductive wire inserted in the case.

To speak more specifically, the metal leaf spring has a head end. After the conductive wire is inserted into the case, the shift member can be pressed down to force the tail end of the metal leaf spring to bite the conductive wire and keep the conductive wire in contact with the metal leaf spring without easy detachment from the insulation case. Only when an operator pushes the shift member upward to release the pressing state, the conductive wire is released from the pressing of the metal leaf spring.

Basically, the metal leaf spring is connected with a finer or narrower terminal pin in a symmetrical form. The terminal pin is inserted on the circuit board and electrically connected with the circuit board.

There is another conventional terminal block or connection terminal. A shift member is disposed on the connection terminal to control the metal leaf spring to press the conductive wire or release the conductive wire. A forked head end is bridged between two sides of the shift member to bear the press of the shift member in response to the operation of the shift member. That is, when the shift member is operated to press the metal leaf spring downward, the tail end of the metal leaf spring is forced to press down the conductive wire entering the terminal block and bite the conductive wire. After the shift member is pushed upward, the rear end section of the shift member will push the forked head end of the metal leaf spring to lift the tail end of the metal leaf spring so as to release the conductive wire from the pressed state.

In the above connection terminal, in order to fix the tail end of the metal leaf spring and keep the tail end pressing down and biting the conductive wire entering the terminal block without detachment, the forked head end of the metal leaf spring is formed with an arched section. A pair of slender arms extends from an upper section of the terminal pin corresponding to the arched section. When the shift member presses down the forked head end of the metal leaf spring, the arched section is forced to enter the arms to be grasped by or latched with the arms. When the shift member is pushed upward, the shift member will push the arched section to leave the arms and release the arched section from the latched state so as to release the conductive wire.

With respect to the structural design and application of such kind of terminal or connection terminal, in order to make the arched section have sufficient structural strength to bear the latch of the arms of the terminal pin and reduce the deformation of the structure so as not to affect the wire-pressing effect of the metal leaf spring, the arched section is practically made with a C-shaped configuration. Obviously, this structural form will increase the complexity in manufacturing of the metal leaf spring and make the manufacturing cost higher.

There is still another electrical conductive wire connection terminal device. In the terminal device, two sides of the pivoted section of the shift member are formed with recessed section and raised section to press α-shaped metal leaf spring. When the shift member is operated and pressed down against the terminal case, the pivoted section of the shift member (or a position of the recessed section near the raised section) is pressed against the bow-shaped curved section of the α-shaped metal leaf spring in a temporary pressing/fixing balanced state. Such kind of terminal device is further equipped with a latch mechanism, springs and other components to help in fixing the shift member or enhancing the stability of location of the shift member. Therefore, such terminal connection is relatively complicated in structure and assembling process.

According to the above, the conventional connection terminal or terminal block that including the shift member, the metal leaf spring and the terminal pin has some shortcomings in assembling process and structural design. The assembling structures of the case, the shift member and the metal leaf spring of the conventional electrical connection terminal need to be redesigned into an improved structure, which is different from the conventional electrical connection terminal in use form and application. Also, the manufacturing cost of the terminal device can be as lowered as possible.

It is therefore tried by the applicant to provide a shift member fixing structure of electrical connection terminal to overcome or improve the above problems of the conventional connection terminal. The shift member fixing structure of electrical connection terminal is advantageous over the conventional connection terminal. For example, in condition that the entire electrical connection terminal is stably assembled and is able to effectively press the conductive wire, the shift member and the metal leaf spring of the electrical connection terminal can cooperate with each other to improve the shortcoming of the conventional connection terminal that the structure is complicated. Also, an operator can more easily and conveniently operate the shift member. Especially, with respect to the assembly of the shift member and the terminal connection or metal leaf spring, the system for pressing the conductive wire is more stable and can more securely fix the conductive wire.

SUMMARY OF THE INVENTION

It is therefore a primary object of the present invention to provide a shift member fixing structure of electrical connection terminal includes an assembly of a terminal and a shift member to improve the shortcoming of the conventional terminal that the structure is complicated and the manufacturing cost is higher. The terminal includes a main body defining a chamber and a metal leaf spring disposed in the chamber for pressing a conductive wire into electrical connection or releasing the conductive wire in response to the operation of the shift member. A predetermined section of the shift member is formed with an insertion section and walls defining the insertion section. A part of the wall is removed to provide elastic effect for the insertion section. The removed part is repositioned on a surface of upper section of the main body to form an interference section. After the shift member is pressed down, the interference section is assembled with the insertion section. Only when an operational force is applied to the shift member to release the shift member from the assembling state, the shift member can be further moved. The shift member fixing structure of electrical connection terminal can be easily and conveniently operated.

In the above shift member fixing structure of electrical connection terminal, the insertion section or the wall of the shift member has a tail end section and a stop end formed on the tail end section. The interference section of the main body includes interference sides and a head end connected with the interference sides corresponding to the stop ends. After the shift member is operated and pressed down, the stop ends will assemble with the interference sides and the head end in an inserted or fixed state, whereby the shift member and the metal leaf spring are secured to keep pressing the conductive wire.

The present invention can be best understood through the following description and accompanying drawings, wherein:

DETAILED DESCRIPTION OF THE PREFERRED EMBODIMENTS

Figure 1:
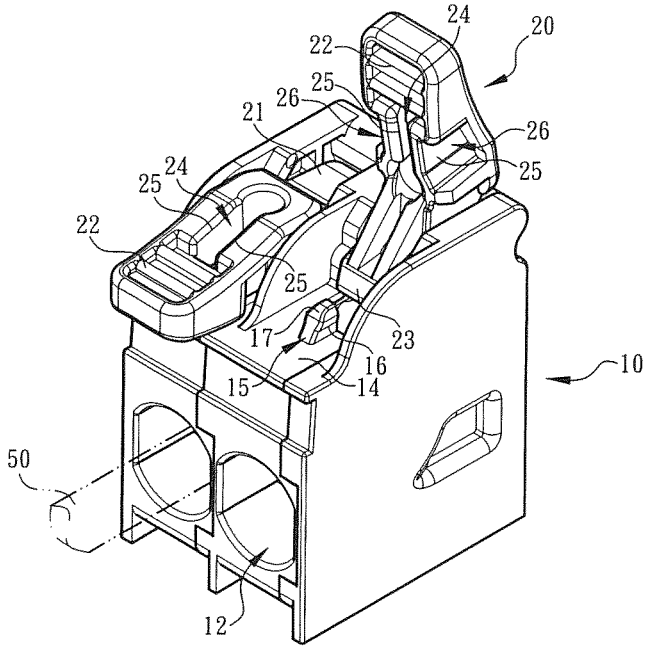
FIG. 1 is a perspective assembled view of the terminal device of the present invention.
Figure 2:
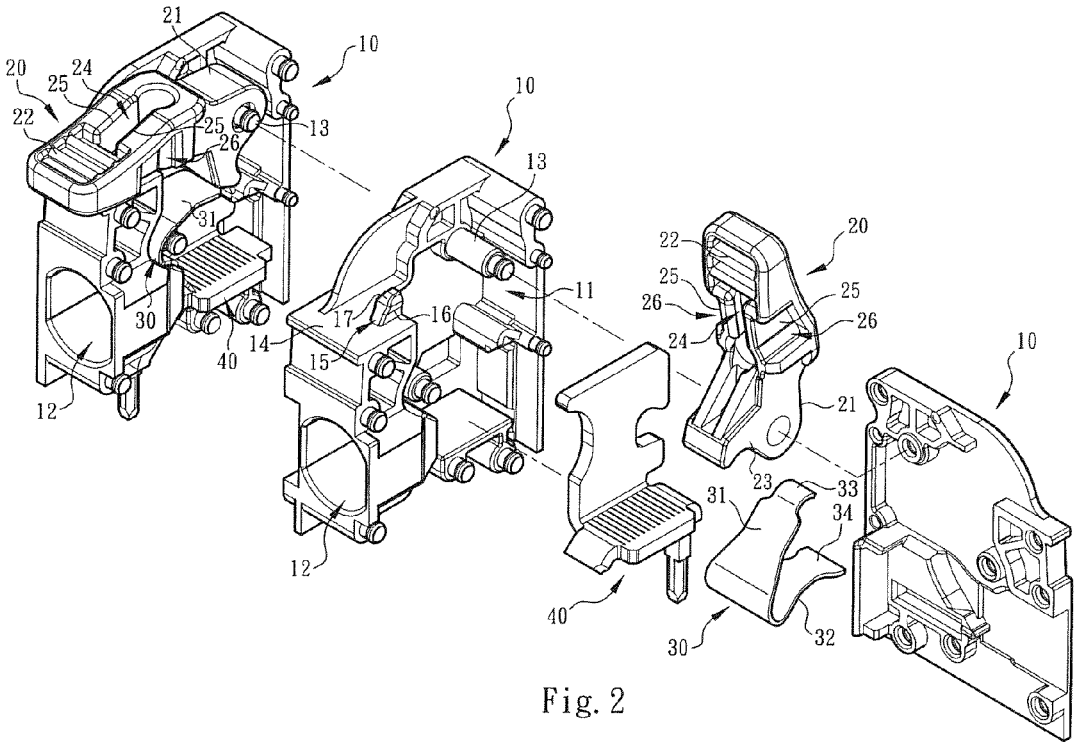
FIG. 2 is a perspective exploded view of the terminal device of the present invention according to FIG. 1, showing the structures of the main body, the shift member, the metal leaf spring and the terminal pin.
Figure 3:
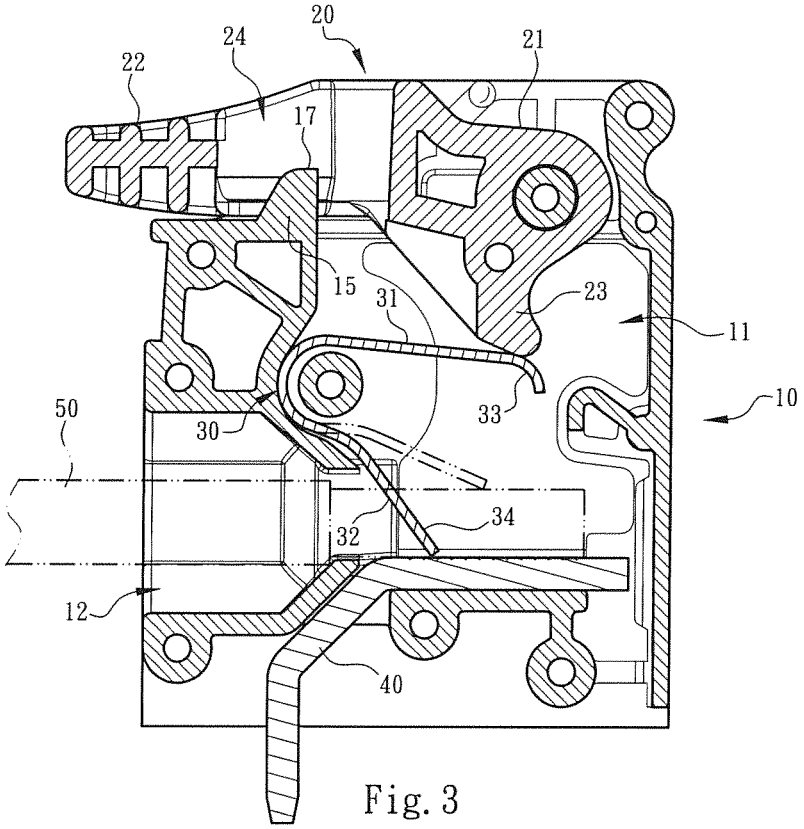
FIG. 3 is a sectional assembled view of the present invention, showing that the shift member is positioned in the closed position to press down the metal leaf spring and showing the positional relationship between the insertion section of the shaft member and the interference section of the main body.

Please refer to FIGS. 1, 2 and 3. The shift member fixing structure of electrical connection terminal of the present invention includes a main body 10 made of insulation material and a shift member 20. The main body 10 defines a cavity 11. A metal leaf spring 30 and a terminal pin 40 are mounted in the chamber 11. The terminal pin 40 is for inserting on a circuit board (such as a PCB). The main body 10 includes a wire inlet 12 in communication with the chamber 11. A conductive wire 50 can be inserted into the chamber 11 through the wire let 12 to be pressed by the metal leaf spring 30, whereby the conductive wire 50 is electrically connected with the terminal pin 40.

In this embodiment, the metal leaf spring 30 is movable along with the motion of the shift member 20 to press the conductive wire 50 into electrical connection with the terminal pin 40 or release the conductive wire 50. To speak more specifically, the shift member 20 includes a pivoted end 21 and an operation end 22. The pivoted end 21 is pivotally connected on a pivot shaft 13 of the main body 10 or the chamber 11, whereby the shift member 20 or the operation end 22 is reciprocally movable between an open position and a closed position. A press section 23 protrudes from the pivoted end 21 in the form of a cantilever for pressing the metal leaf spring 30.

To speak more specifically, the metal leaf spring 30 has a first section 31 and a second section 32. The first section 31 includes a head end 33 and the second section 32 includes a tail end 34. The first section 31 or the head end 33 contacts the press section 23 of the shift member 20, whereby the press section 23 can press down the first section 31 or the head end 33 of the metal leaf spring 30 and make the tail end 34 press or bite the conductive wire 50 entering the chamber 11. After the shift member 20 is operated and pushed upward, the conductive wire 50 is released from the press of the tail end 34.

In this embodiment, a predetermined section of the shift member 20 is formed with an insertion section 24 and at least two walls 25 defining two sides of the insertion section 24, whereby the insertion section 24 has the form of a cave structure. In this embodiment, partial material of the wall 25 is removed to form a depression section 26 so as to reduce the thickness of the wall 25. The depression section 26 also provides an elastic effect for the insertion section 24 or the wall 25. In addition, the removed part is repositioned on a surface 14 of upper section of the main body 10 to form an interference section 15. After the shift member 20 is operated and pressed down, the interference section 15 will assemble with the insertion section 24 of the shift member. Only when an operational force is applied to the shift member to release the shift member from the assembling or interference state, the shift member 20 can be moved.

The predetermined section of the shift member 20 is a section between the pivoted end 21 and the operation end 22. The insertion section 24 or the wall 25 has an elastic effect so that the assembling tolerance between the insertion section 24 and the interference section 15 can be easily controlled and the interference force applied to the insertion section 24 of the shift member inserted with the interference section 15 is relatively stable. Especially, when the shift member is operated to insert the insertion section 24 with the interference section 15, the elastic effect of the insertion section 24 also enhances the operational hand feeling of the operator.

Figure 4:
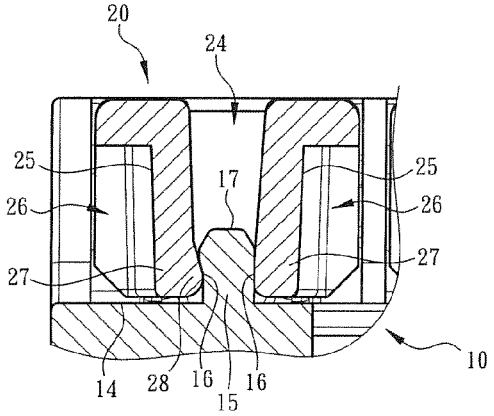
FIG. 4 is a sectional view showing that the insertion section of the shaft member is inserted with the interference section of the main body in one aspect, in which the insertion section or at least one wall of the insertion section is formed with a stop end in adaptation to the interference section.
Figure 5:
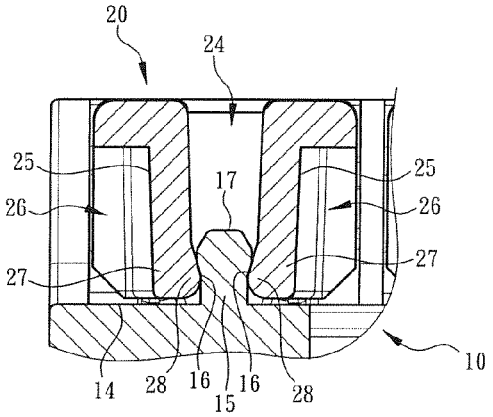
FIG. 5 is a sectional view showing that the insertion section of the shaft member is inserted with the interference section of the main body in another aspect, in which the insertion section or both walls of the insertion section are formed with stop ends in adaptation to the interference section.

Please now refer to FIGS. 4 and 5. The insertion section 24 or the wall 25 of the shift member has a tail end section 27 and a stop end 28 formed on the tail end section 27. The stop end 28 can be a raised section or recessed section. As shown in FIGS. 4 and 5, in this embodiment, the stop end 28 is a raised structure, whereby the width between the tail end sections 27 is smaller than the width of the insertion section 24 between the walls 25.

In addition, the interference section 15 of the main body includes interference sides 16 and a head end 17 connected with the interference sides 16. The interference sides 16 can be recessed structures or raised structures corresponding to the structural form of the stop ends 28. As shown in the drawings, the width of the head end 17 is larger than the width between the interference sides 16.

It should be noted that FIG. 4 shows that at least one wall 25 of the insertion section 24 is formed with the stop end 28. FIG. 5 shows that both walls 25 of the insertion section 24 are formed with the stop ends 28.

After the shift member 20 is operated and pressed down, the stop ends 28 will pass over the head end 17 of the interference section 15 to interfere and assemble with the interference sides 16 in an inserted or fixed state, whereby the shift member 20 and the metal leaf spring 30 are secured to keep pressing the conductive wire 50.

Figure 6:
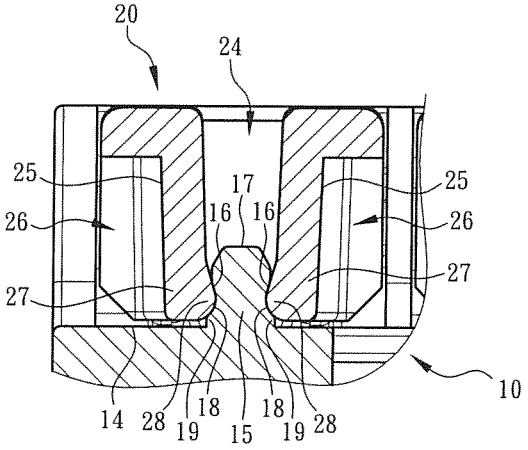
FIG. 6 is a sectional view showing that the insertion section of the shaft member is inserted with the interference section of the main body in still another aspect, in which the insertion section or both walls of the insertion section are formed with stop ends in adaptation to the recessed sections and base sections of the interference sides of the interference section.

Please now refer to FIG. 6. In a modified embodiment, the interference sides 16 are formed with recessed sections 18 and base sections 19 connected with the recessed sections 18. That is, the interference sides 16 between the head end 17 and the base sections 19 are formed with recessed structures 18. After the shift member 20 is operated and pressed down, the stop ends 28 will pass over the head end 17 of the interference section 15 to enter the recessed sections 18 of the interference sides 16 in an inserted or fixed state.

It should be noted that when a user applies an operational force to the shift member to release the insertion section 24 from the insertion of the interference section 15, the user can push the shift member 20 upward to release the metal leaf spring 30 from the pressing of the press section 23 and thus make the conductive wire 50 released from the pressing of the metal leaf spring 30.

According to the above, the shift member fixing structure of electrical connection terminal of the present invention can be optimally and stably operated. In comparison with the conventional electrical connection terminal, the shift member fixing structure of electrical connection terminal of the present invention has the following advantages:

1. The shift member fixing structure of electrical connection terminal and the relevant connection components of the present invention have been redesigned in use, structure design and connection relationship to be different from the conventional electrical connection terminal. (For example, the shift member 20 is formed with an insertion section 24 and the walls 25 defining the insertion section 24. Partial material of the wall 25 is removed to form a depression section 26 so as to provide elastic effect for the insertion section 24 or the wall 25. The removed part is repositioned on the main body 10 to form an interference section 15. The insertion section 24 has stop ends 28. The interference section 15 includes interference sides 16 and a head end 17 corresponding to the stop ends 28). The use form of the shift member fixing structure of electrical connection terminal is also changed and the application range of the shift member fixing structure of electrical connection terminal is widened. In the condition that the entire structure is stably assembled and is able to press the conductive wire 50, the shift member fixing structure of electrical connection terminal of the present invention can be more easily and conveniently operated than the conventional electrical connection terminal structure.
2. Especially, the main body 10 and the shift member 20 are directly formed with the interference section 15 and the cooperative insertion section 24. This improves the shortcoming of the conventional electrical connection terminal that the latch mechanism, the spring and the other components have complicated structures and are uneasy to manufacture and install and the manufacturing cost is higher. Moreover, the insertion section 24 or the walls 25 have elastic effect, whereby the assembling tolerance between the insertion section 24 and the interference section 15 can be easily controlled and the interference force applied to the insertion section 24 of the shift member inserted with the interference section 15 is relatively stable. Also, when an operator operates the shift member to insert the insertion section 24 with the interference section 15, the elastic effect of the insertion section also enhances the operational hand feeling of the operator.

In conclusion, the shift member fixing structure of electrical connection terminal of the present invention is effective and different from the conventional electrical connection terminal in space form. The shift member fixing structure of electrical connection terminal of the present invention is inventive and greatly advanced and advantageous over the conventional electrical connection terminal.

The above embodiments are only used to illustrate the present invention, not intended to limit the scope thereof. Many modifications of the above embodiments can be made without departing from the spirit of the present invention.

What is claimed is:

1. A shift member fixing structure of electrical connection terminal, comprising:

a main body defining a chamber, the main body having a wire inlet in communication with the chamber;

a shift member having a pivoted end pivotally connected with the main body and an operation end, the shift member being reciprocally movable between an open position and a closed position, the shift member further having a press section; and a metal leaf spring disposed in the chamber, the metal leaf spring having a first section and a second section, the first section having a head end, the second section having a tail end, the press section serving to press and move the first section of the metal leaf spring so as to press a conductive wire and electrically connect with the conductive wire, a predetermined section of the shift member being formed with an insertion section and at least two walls defining at least two sides of the insertion section, the main body being formed with an interference section for correspondingly assembling with the insertion section of the shift member.

2. The shift member fixing structure of electrical connection terminal as claimed in claim 1, wherein the press section of the shift member is a cantilever structure protruding from the pivoted end, the predetermined section of the shift member being a section between the pivoted end and the operation end, the insertion section of the shift member having the form of a cave structure, a part of the wall defining the insertion section being removed to form a depression section to provide an elastic effect for the insertion section or the wall, the interference section being formed on a surface of upper section of the main body.

3. The shift member fixing structure of electrical connection terminal as claimed in claim 1, wherein a terminal pin is mounted in the chamber, the terminal pin being for inserting on a circuit board, the wire inlet of the main body being for a conductive wire to be inserted into the chamber and pressed by the tail end of the metal leaf spring to electrically connect with the terminal pin.

4. The shift member fixing structure of electrical connection terminal as claimed in claim 2, wherein a terminal pin is mounted in the chamber, the terminal pin being for inserting on a circuit board, the wire inlet of the main body being for a conductive wire to be inserted into the chamber and pressed by the tail end of the metal leaf spring to electrically connect with the terminal pin.

5. The shift member fixing structure of electrical connection terminal as claimed in claim 1, wherein at least one wall of the insertion section of the shift member has a tail end section and a stop end formed on the tail end section, the stop end being a raised structure, whereby a width between the tail end sections is smaller than a width of the insertion section between the walls, the interference section of the main body including interference sides and a head end connected with the interference sides, the interference sides being formed with recessed structures corresponding to the raised structures of the stop ends, whereby a width of the head end of the interference section is larger than a width between the interference sides.

6. The shift member fixing structure of electrical connection terminal as claimed in claim 2, wherein at least one wall of the insertion section of the shift member has a tail end section and a stop end formed on the tail end section, the stop end being a raised structure, whereby a width between the tail end sections is smaller than a width of the insertion section between the walls, the interference section of the main body including interference sides and a head end connected with the interference sides, the interference sides being formed with recessed structures corresponding to the raised structures of the stop ends, whereby a width of the head end of the interference section is larger than a width between the interference sides.

7. The shift member fixing structure of electrical connection terminal as claimed in claim 3, wherein at least one wall of the insertion section of the shift member has a tail end section and a stop end formed on the tail end section, the stop end being a raised structure, whereby a width between the tail end sections is smaller than a width of the insertion section between the walls, the interference section of the main body including interference sides and a head end connected with the interference sides, the interference sides being formed with recessed structures corresponding to the raised structures of the stop ends, whereby a width of the head end of the interference section is larger than a width between the interference sides.

8. The shift member fixing structure of electrical connection terminal as claimed in claim 1, wherein at least one wall of the insertion section of the shift member has a tail end section and a stop end formed on the tail end section, the stop end being a recessed structure, the interference section of the main body including interference sides and a head end connected with the interference sides, the interference sides being formed with raised structures corresponding to the recessed structures of the stop ends.

9. The shift member fixing structure of electrical connection terminal as claimed in claim 2, wherein at least one wall of the insertion section of the shift member has a tail end section and a stop end formed on the tail end section, the stop end being a recessed structure, the interference section of the main body including interference sides and a head end connected with the interference sides, the interference sides being formed with raised structures corresponding to the recessed structures of the stop ends.

10. The shift member fixing structure of electrical connection terminal as claimed in claim 3, wherein at least one wall of the insertion section of the shift member has a tail end section and a stop end formed on the tail end section, the stop end being a recessed structure, the interference section of the main body including interference sides and a head end connected with the interference sides, the interference sides being formed with raised structures corresponding to the recessed structures of the stop ends.

11. The shift member fixing structure of electrical connection terminal as claimed in claim 5, wherein both walls of the insertion section are formed with the stop ends.

12. The shift member fixing structure of electrical connection terminal as claimed in claim 6, wherein both walls of the insertion section are formed with the stop ends.

13. The shift member fixing structure of electrical connection terminal as claimed in claim 7, wherein both walls of the insertion section are formed with the stop ends.

14. The shift member fixing structure of electrical connection terminal as claimed in claim 8, wherein both walls of the insertion section are formed with the stop ends.

15. The shift member fixing structure of electrical connection terminal as claimed in claim 9, wherein both walls of the insertion section are formed with the stop ends.

16. The shift member fixing structure of electrical connection terminal as claimed in claim 10, wherein both walls of the insertion section are formed with the stop ends.

17. The shift member fixing structure of electrical connection terminal as claimed in claim 5, wherein the interference sides are formed with base sections connected with the recessed sections.

18. The shift member fixing structure of electrical connection terminal as claimed in claim 6, wherein the interference sides are formed with base sections connected with the recessed sections.

19. The shift member fixing structure of electrical connection terminal as claimed in claim 7, wherein the interference sides are formed with base sections connected with the recessed sections.

* * * * *